US008567332B1

(12) United States Patent
Bassler et al.

(10) Patent No.: US 8,567,332 B1
(45) Date of Patent: Oct. 29, 2013

(54) ADVANCED BILGE KEEL DESIGN

(75) Inventors: Christopher C. Bassler, Arlington, VA (US); Allan Scott Percival, Gaithersburg, MD (US); Martin J. Dipper, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 249 days.

(21) Appl. No.: 13/169,888

(22) Filed: Jun. 27, 2011

(51) Int. Cl.
*B63B 3/44* (2006.01)
*B63B 39/06* (2006.01)

(52) U.S. Cl.
USPC ..... 114/142

(58) Field of Classification Search
USPC ..... 114/140–143, 278
See application file for complete search history.

(56) References Cited

U.S. PATENT DOCUMENTS

| | | | | |
|---|---|---|---|---|
| 139,222 | A | 5/1873 | Willeby | |
| 650,333 | A | 5/1900 | Martens | |
| 1,851,768 | A | 7/1930 | Hubbell | |
| 1,864,102 | A * | 6/1932 | Telfer | 114/142 |
| 2,878,772 | A * | 3/1959 | Kjekstad | 114/126 |
| 2,997,974 | A * | 8/1961 | Hamlin | 114/142 |
| 3,570,438 | A | 3/1971 | Mackowiak | |
| 5,460,110 | A | 10/1995 | Eronen et al. | |
| 6,176,191 | B1 | 1/2001 | Fernandes et al. | |
| 7,500,440 | B2 * | 3/2009 | Chiu | 114/143 |
| 7,900,570 | B2 * | 3/2011 | Chiu | 114/143 |

* cited by examiner

*Primary Examiner* — Daniel Venne
(74) *Attorney, Agent, or Firm* — Dave A. Ghatt

(57) ABSTRACT

An advanced bilge keel design for improved ship roll damping performance. The advanced bilge keel design includes curved upper and bottom surfaces and improved free end edge design for providing passive roll stabilization and improved energy dissipation.

14 Claims, 5 Drawing Sheets

ADVANCED BILGE KEEL DESIGN

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an advanced bilge keel design for improved ship roll damping performance. More particularly, an advanced bilge keel design having curved upper and bottom surfaces and improved free end design for providing passive roll stabilization and improved energy dissipation.

BACKGROUND

Since the mid-1800s, ships have used bilge keels to mitigate roll motions due to waves. The use of bilge keels to minimize ship roll motion was first suggested by Froude. Historically, bilge keels have featured flat plate designs, and later also included discontinuous fin or wedge type designs along the ship's length. FIG. 1 shows a conventional flat bilge keel 10. Conventional bilge keels are used to mitigate and dampen small to moderate roll motions. As ships have increasingly expanded operations into more severe environments, conventional bilge keels have been less effective.

Older conventional bilge keels were typically constructed from a metal plate and filled with wood, and then riveted to the hull at the desired location. Modern bilge keels are constructed entirely from metal plates, and filled with foam-based materials. Due to considerations related to docking at piers and to operations in shallow waters, bilge keels are typically constrained to not protrude beyond the beam or the keel of the ship. For these reasons, the size of bilge keels is limited, and has not been increased substantially, which would provide more effectiveness. Thus, it is desired to have bilge keels that provide increased stability without increasing the width. The prior art does not teach bilge keels with curved surfaces and shaped edges for providing stability and energy dissipation optimization.

SUMMARY

In one aspect, the invention is a ship with passive roll stabilization. In this aspect, the invention includes a hull having a forward end, an aft end, a port side, and a starboard side. The invention further includes a waterline region along the hull having a waterline that coincides with the level at which the hull floats in open water. In this aspect, the invention further includes first and second advanced bilge keels mounted along the hull within or below the waterline region. The first advanced bilge keel is positioned along a streamline on the port side of the hull extending from the forward end to the aft end, and the second advanced bilge keel is positioned along a streamline on the starboard side of the hull extending from the forward end to the aft end. Each of the first and the second advanced bilge keels include an attachment end attached to the hull, a free end, a curved upper surface extending from the attachment end to the free end, and a curved bottom surface below the curved upper surface, extending from the attachment end to the free end.

In another aspect, the invention is an advanced bilge keel mountable to a ship hull within or below a waterline region. The advanced bilge keel includes an attachment end attachable to the hull, a free end, a curved upper surface extending from the attachment end to the free end, and a curved bottom surface below the curved upper surface, extending from the attachment end to the free end.

BRIEF DESCRIPTION OF THE DRAWINGS

Other features will be apparent from the description, the drawings, and the claims.

DETAILED DESCRIPTION

Figure 2A:
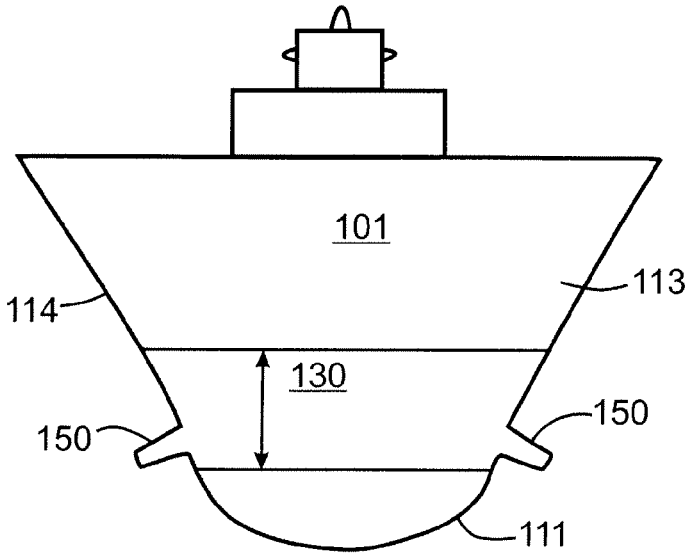
FIG. 2A is an exemplary front view of a ship having passive roll stabilization, according to an embodiment of the invention.
Figure 2B:
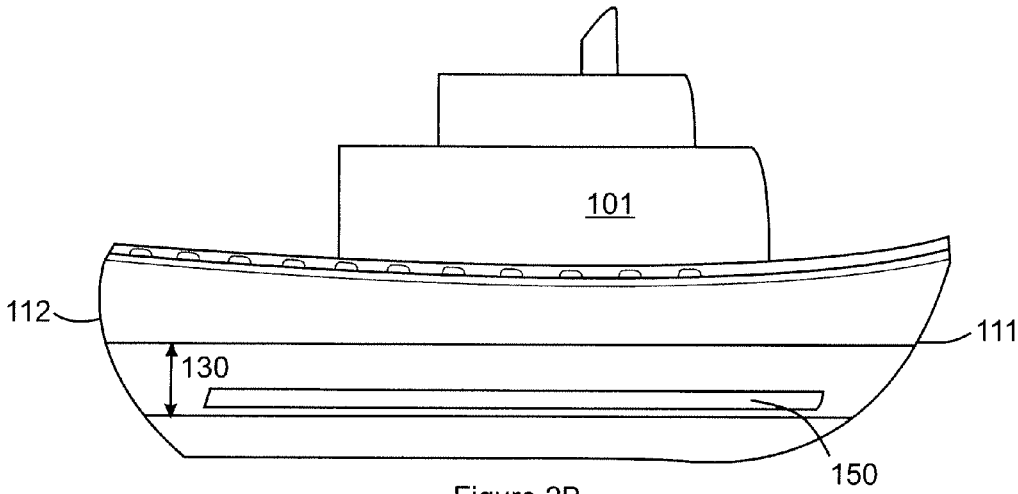
FIG. 2B is an exemplary side view of a ship having passive roll stabilization, according to an embodiment of the invention.

FIGS. 2A and 2B are exemplary sectional illustrations of a ship hull 101 having passive roll stabilization, according to an embodiment of the invention. The ship may be any type of ship, such as a commercial or non-commercial cargo ship, a cruise ship, a naval ship, or a smaller ship. The hull 101 includes a propulsion system commensurate with the type of ship. For example, the hull 101 may include propulsors that provide thrusting forces based on the rotation of propellers, or the ship may be propelled by waterjets discharged into the air above the water surface. The propulsors may propel the ship 101 at any desired speed, including speeds of up to 40 knots and more.

Figure 1:
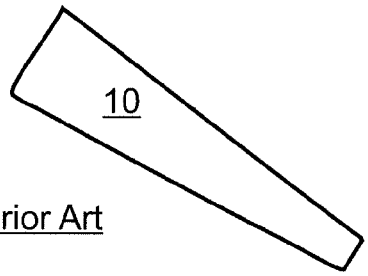
Prior Art Figure 1
FIG. 1 is a sectional illustration of a conventional bilge keel.

FIGS. 2A and 2B show the hull 101 having a forward end 111, an aft end 112, a port side 113, and a starboard side 114. FIG. 2A shows two advanced bilge keels 150 attached to the hull 101. A first bilge keel 150 is attached to a port side 113 of the hull 101, and a second bilge keel 150 is attached to a starboard side 114. As outlined below, the bilge keels 150 are provided to enable passive roll stabilization and to reduce the severity of ship roll motions. As outlined below, according to the invention, the bilge keels 150 have curved upper and lower surfaces that provide stability and energy dissipation optimization, without increasing the width of conventional bilge keels 150. As shown, the hull 101 includes a waterline region 130 that represents the region of possible waterlines on the hull. The bilge keel 150 is positioned within or below the waterline region 130. The bilge keel 150 may be fabricated using steel, composites, and the like. The bilge keel 150 may also be formed by retrofitting existing conventional bilge keels, such as the flat conventional bilge keel 10 shown in FIG. 1.

Figure 3B:
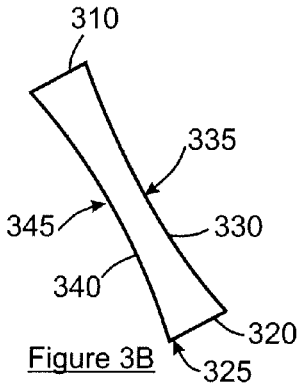
FIG. 3B is an exemplary sectional illustration of an advanced bilge keel, according to an embodiment of the invention.
Figure 3A:
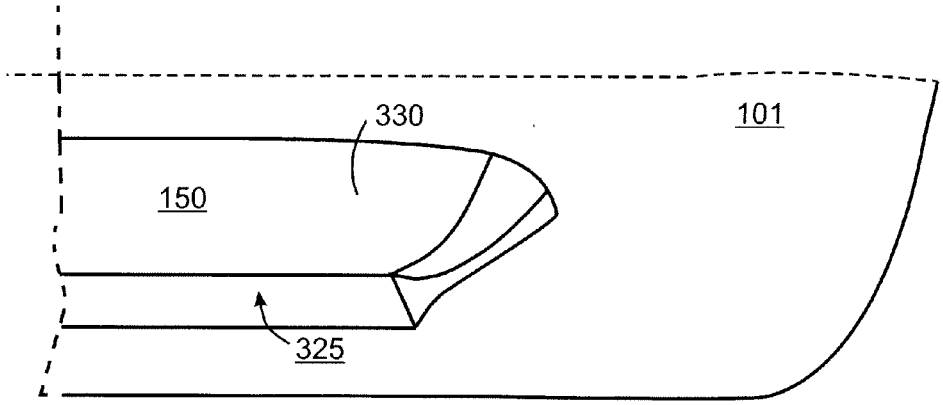
FIG. 3A is an exemplary perspective illustration of an advanced bilge keel attached to a ship, according to an embodiment of the invention.

FIG. 3A is an exemplary perspective illustration of an advanced bilge keel 150 attached to a ship hull 101, according to an embodiment of the invention. In the illustration, the bilge keel 150 is attached to the starboard side 114, within or below the waterline region 130. Thus, the bilge keel 150 is mounted in the wet zone, and may be mounted along a streamline for typical operational speeds. Not shown in FIG. 3A is the matching bilge keel 150 attached in a similar manner, to the port side 113 of the ship hull 101. FIG. 3B is an exemplary sectional illustration of an advanced bilge keel 150, according to the embodiment shown in FIG. 3A. As shown in FIGS. 3A and 3B, the advanced bilge keel 150 includes an attachment end 310 at which the bilge keel 150 is attached to the ship hull 101. The bilge keel 150 also includes a free end 320, and a curved upper surface 330 extending from the attachment end 310 to the free end 320. Also shown is a curved bottom surface 340 below the upper surface 330, the curved bottom surface extending from the attachment end 310 to the free end 320.

FIGS. 3A and 3B also show the upper surface 330 of the advanced bilge keel being curved downwards forming a central trough region 335. The bottom surface 340 is curved upwards forming a central crest region 345. As shown, the central trough region 335 and the central crest region 345 are aligned so that the bilge keel has a substantially biconcave cross section. Also shown is the flat edge 325 that extends from the upper surface 330 to the bottom surface 340. The tip geometry, i.e., the flat edge 325 stimulates increased energy dissipation through vortex shedding and wave-making, and decreases the severity of ship roll motions. The overall design of the advanced bilge keel 150 as shown in FIGS. 3A and 3B may also provide additional lift, depending upon operational speed, thereby providing fuel savings.

Figure 4A:
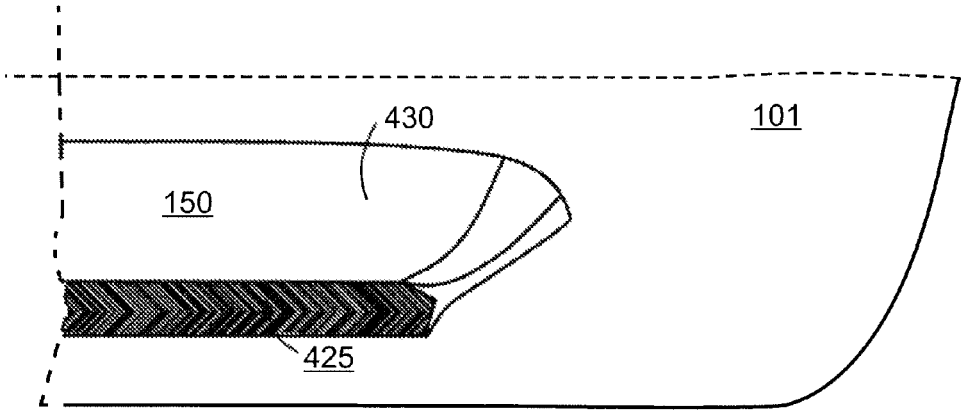
FIG. 4A is an exemplary perspective illustration of an advanced bilge keel attached to a ship, according to an embodiment of the invention.
Figure 4B:
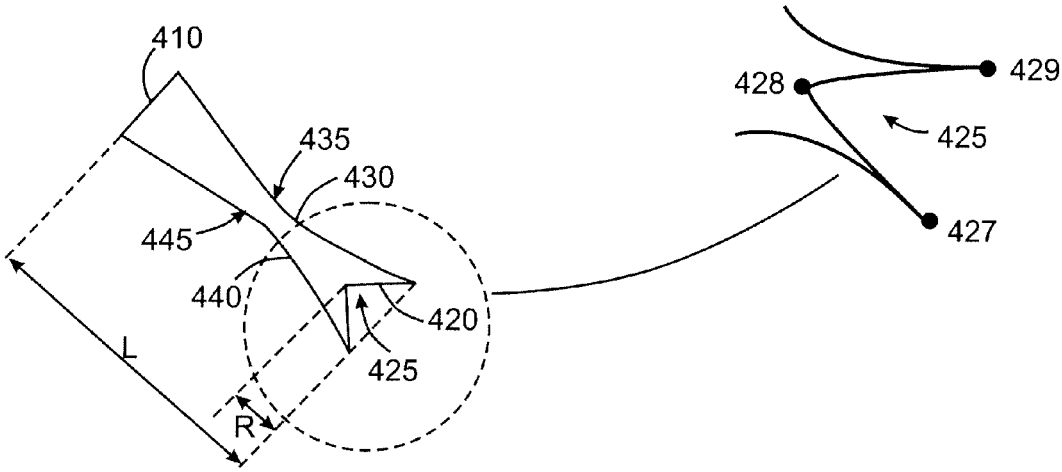
FIG. 4B is an exemplary sectional illustration of an advanced bilge keel, according to an embodiment of the invention.

FIG. 4A is an exemplary perspective illustration of an advanced bilge keel 150 attached to a ship hull 101, according to an embodiment of the invention. In the illustration, the bilge keel 150 is attached to the starboard side 114, within or below the waterline region 130. Thus, the bilge keel 150 is mounted in the wet zone, and may be mounted along a streamline for typical operational speeds. Not shown in FIG. 4A is the matching bilge keel 150 attached in a similar manner, to the port side 113 of the ship hull 101. FIG. 4B is an exemplary sectional illustration of an advanced bilge keel 150, according to the embodiment shown in FIG. 4A. As shown in FIGS. 4A and 4B, the advanced bilge keel 150 includes an attachment end 410 at which the bilge keel 150 is attached to the ship hull 101. The bilge keel 150 also includes a free end 420, and a curved upper surface 430 extending from the attachment end 410 to the free end 420. Also shown is a curved bottom surface 440 below the upper surface 430, the curved bottom surface extending from the attachment end 410 to the free end 420.

FIGS. 4A and 4B also show the upper surface 430 of the advanced bilge keel being curved downwards forming a central trough region 435. The bottom surface 440 is curved upwards forming a central crest region 445. As shown, the central trough region 435 and the central crest region 445 are aligned so that the bilge keel has a substantially biconcave cross section. Also shown is a forked edge 425 at the free end 420. As shown in the magnified view, the forked edge 425, at the bottom surface at 427, extends diagonally inwards towards the attachment end 410, and at substantially a halfway point 428 between the upper and lower surfaces, extends diagonally outwards toward the upper surface 430, with the edge 425 terminating at the at 429.

FIG. 4B shows the bilge keel 150 having a lateral sectional length L. FIG. 4B also shows the forked edge 425 having a length of R, which as illustrated is a part of the lateral sectional length L. According to an embodiment of the invention, the R may be about 0.10 to about 0.15 of the length L. According to another embodiment, R may be about 0.12 of the length L. The tip geometry, i.e., the forked edge 425 as outlined above, stimulates increased energy dissipation through vortex shedding and wave-making, and decreases the severity of ship roll motions. The overall design of the advanced bilge keel 150 as shown in FIGS. 4A and 4B may also provide additional lift, depending on operational speed, which would provide fuel savings.

Figure 5A:
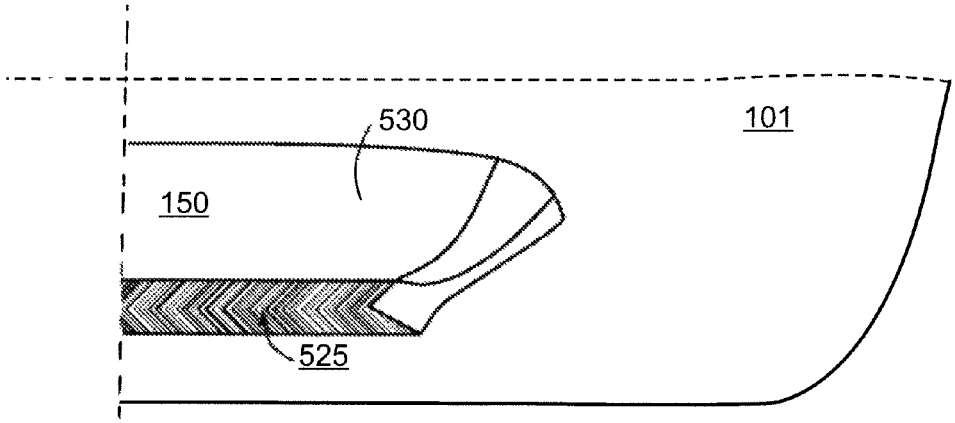
FIG. 5A is an exemplary perspective illustration of an advanced bilge keel attached to a ship, according to an embodiment of the invention.
Figure 5B:
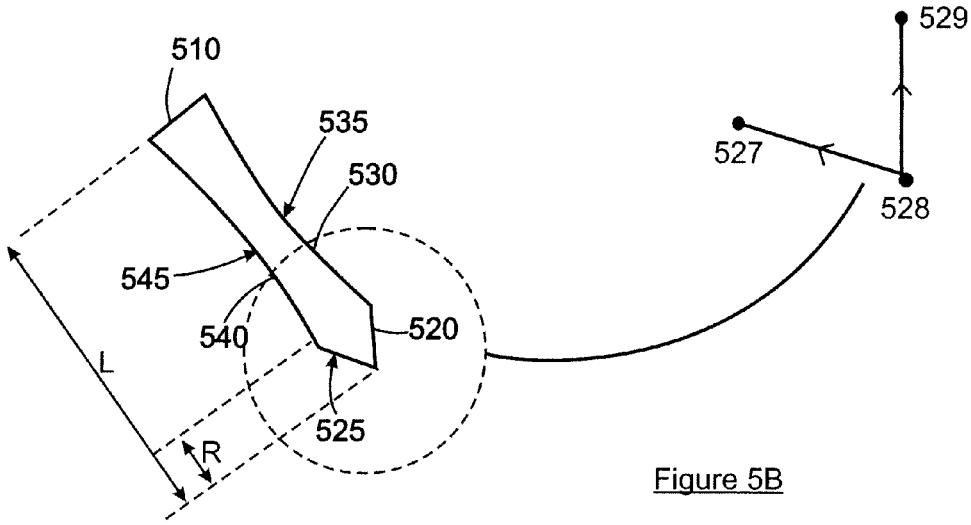
FIG. 5B is an exemplary sectional illustration of an advanced bilge keel, according to an embodiment of the invention.

FIG. 5A is an exemplary perspective illustration of an advanced bilge keel 150 attached to a ship hull 101, according to an embodiment of the invention. As with the above outlined embodiments, in the illustration the bilge keel 150 is attached to the starboard side 114, within or below the waterline region 130. Thus, the bilge keel 150 is mounted in the wet zone, and may be mounted along a streamline for typical operational speeds. Not shown in FIG. 5A is the matching bilge keel 150 attached in a similar manner, to the port side 113 of the ship hull 101. FIG. 5B is an exemplary sectional illustration of an advanced bilge keel 150, according to the embodiment shown in FIG. 5A. As shown in FIGS. 5A and 5B, the advanced bilge keel 150 includes an attachment end 510 at which the bilge keel 150 is attached to the ship hull 101. The bilge keel 150 also includes a free end 520, and a curved upper surface 530 extending from the attachment end 510 to the free end 520. Also shown is a curved bottom surface 540 below the upper surface 530, the curved bottom surface extending from the attachment end 510 to the free end 520.

As with the above-described embodiments, FIGS. 5A and 5B also show the upper surface 530 of the advanced bilge keel being curved downwards forming a central trough region 535. The bottom surface 540 is curved upwards forming a central crest region 545. As shown, the central trough region 535 and the central crest region 545 are aligned so that the bilge keel has a substantially biconcave cross section. Also shown is a forked edge 525 at the free end 520. As shown in the magnified view, the arrow-pointed edge 525, at the bottom surface at 527, extends outwards diagonally away from the attachment end, and at a substantially halfway point 528 between the bottom and upper surfaces, extends diagonally inwards toward the upper surface 530, with the edge 525 terminating at the at 529.

FIG. 5B shows the bilge keel 150 having a lateral sectional length L. FIG. 5B also shows the arrow-pointed edge 525 having a length of r, which as illustrated is a part of the lateral sectional length L. According to an embodiment of the invention, the r may be about 0.10 to about 0.15 of the length L. According to another embodiment, r may be about 0.12 of the length L. The tip geometry, i.e., the arrow-pointed edge 525 as outlined above, stimulates increased energy dissipation through vortex shedding and wave-making, and decreases the severity of ship roll motions. The overall design of the advanced bilge keel 150 as shown in FIGS. 5A and 5B may also provide additional lift, depending on operational speed, which would provide fuel savings.

Figure 6A:
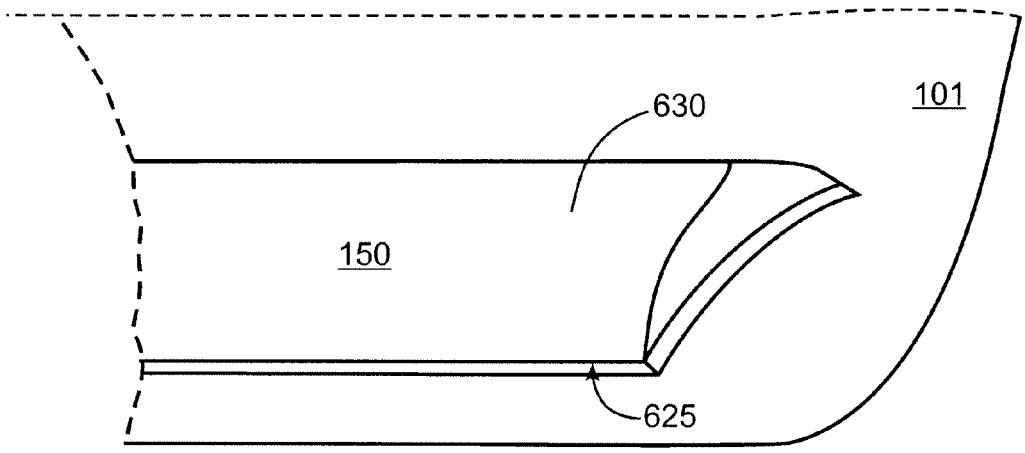
FIG. 6A is an exemplary perspective illustration of an advanced bilge keel attached to a ship, according to an embodiment of the invention.
Figure 6B:
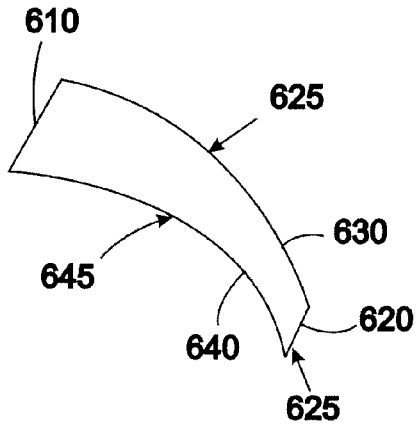
FIG. 6B is an exemplary sectional illustration of an advanced bilge keel, according to an embodiment of the invention.

FIG. 6A is an exemplary perspective illustration of an advanced bilge keel 150 attached to a ship hull 101, according to an embodiment of the invention. As with the above outlined embodiments, in the illustration the bilge keel 150 is attached to the starboard side 114, within or below the waterline region 130. Thus, the bilge keel 150 is mounted in the wet zone, and may be mounted along a streamline for typical operational speeds. Not shown in FIG. 6A is the matching bilge keel 150 attached in a similar manner, to the port side 113 of the ship hull 101. FIG. 6B is an exemplary sectional illustration of an advanced bilge keel 150, according to the embodiment shown in FIG. 6A. As shown in FIGS. 6A and 6B, the advanced bilge keel 150 includes an attachment end 610 at which the bilge keel 150 is attached to the ship hull 101. The bilge keel 150 also includes a free end 620, and a curved upper surface 630 extending from the attachment end 610 to the free end 620. Also shown is a curved bottom surface 640 below the upper surface 630, the curved bottom surface extending from the attachment end 610 to the free end 620.

FIGS. 6A and 6B also show the upper surface 630 of the advanced bilge keel being curved upwards forming a central crest region 635. The bottom surface 640 is curved upwards forming a central crest region 645, the upper and lower surfaces having similar curvatures. The curvatures of the respective surfaces 630 and 640 may be identical or they may be different. As shown, the central crest regions 635 and 645 of the upper and bottom surfaces may be offset so that the distance between the upper and bottom surface at the attachment end 610 is greater than the distance between the upper and bottom surface at the free end 620. Thus, a cambered edge 625 is formed at the free end 620, with an acute angle is formed between the bottom surface 640 and the cambered edge 625 and an obtuse angle formed between the upper surface 630 and the cambered edge.

The tip geometry, i.e., the cambered edge 625 stimulates increased energy dissipation through vortex shedding and wave-making, and decreases the severity of ship roll motions. The overall design of the advanced bilge keel 150 as shown in FIGS. 6A and 6B may also provide additional lift, depending on operational speed, which would provide fuel savings. It should be noted that the advanced bilge keel 150 as described with respect to FIGS. 3A-6B, may be retrofitted to previously installed conventional bilge keels.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A ship with passive roll stabilization, comprising:

a hull having;

a forward end, an aft end, a port side, and a starboard side, a waterline region along the hull having a waterline that coincides with the level at which the hull floats in open water;

first and second bilge keels mounted along the hull within or below a waterline region representing a region of possible waterlines on the hull, the first bilge keel positioned along a streamline side portion of the hull along the waterline regio the port side of the hull extending from the forward end to the aft end, and the second bilge keel positioned along a streamline side portion of the hull along the waterline reign of the starboard side of the hull extending from the forward end to the aft end, wherein each of the first and the second bilge keels comprise:

an attachment end attached to the hull;

a free end;

a curved upper surface extending from the attachment end to the free end; and a curved bottom surface below the curved upper surface, extending from the attachment end to the free end, wherein in each of the first and the second bilge keels, the upper surface is curved downwards forming a central trough region, and the bottom surface is curved upwards forming a central crest region, with the central trough region of the upper surface and the central crest region of the lower surface aligned so that the bilge keel has a substantially biconcave cross section.

2. The ship of claim 1, wherein in each of the first and the second bilge keels, the free end forms a flat edge that extends from the upper surface to the bottom surface.

3. The ship of claim 1, wherein in each of the first and the second bilge keels, the free end forms a forked edge that from the bottom surface extends inwards towards the attachment end, and at a substantially halfway point between the bottom and upper surfaces, extends hack outwards in an opposite direction to the upper surface.

4. The ship of claim 3, wherein each of the first and second bilge keels has a lateral sectional length L that includes a forked edge length R, wherein the forked edge length R is about 0.10 to about 0.15 of the lateral sectional length L.

5. The ship of claim 1, wherein in each of the first and the second bilge keels, the free end forms an arrow-pointed edge that from the bottom surface extends outwards away from the attachment end, and at a substantially halfway point between the bottom and upper surfaces, extends inwards in an opposite direction to the upper surface.

6. The ship of claim 5, wherein each of the first and second bilge keels has a lateral sectional length L that includes an arrow-pointed edge length r, wherein the arrow-pointed edge length r is about 0.10 to about 0.15 of the lateral sectional length L.

7. A ship with passive roll stabilization, comprising:

a hull having:

a forward end, an aft end, a port side, and a starboard side, a waterline region along the hull having a waterline that coincides with the level at which the hull floats in open water;

first and second bilge keels mounted along the hull within or below a waterline region representing a region of possible waterlines on the hull, the first bilge keel positioned along a streamline side portion of the lull along the waterline region of the port side of the hull extending from the forward end to the aft end, and the second bilge keel positioned along a streamline side portion of the hull along the waterline region of the starboard side of the hull extending from the forward end to the aft end, wherein each of the first and the second bilge keels comprise:

an attachment end attached to the hull;

a free end;

a curved upper surface extending from the attachment end to the free end; and a curved bottom surface below the curved upper surface, extending from the attachment end to the free end, wherein in each of the first and the second bilge keels, the upper surface is curved upwards fanning a central crest region, and the bottom surface is curved upwards forming a central crest region, and wherein the central crest region of the upper surface and the central crest region of the lower surface offset so that at the distance between the upper and bottom surfaces at the attachment end is great than the distance between the upper and bottom surfaces at the free end, wherein in each of the first and the second bilge keels, the free end forms a cambered edge with an acute angle being formed between the bottom surface and the cambered edge and an obtuse angle formed between the upper surface and the cambered edge.

8. A bilge keel mountable to a ship hull within or below a waterline region, comprising:

an attachment end attachable to the hull;

a free end;

a curved upper surface extending from the attachment end to the free end; and a curved bottom surface below the curved upper surface, extending from the attachment end to the free end, wherein the upper surface is curved downwards forming a central trough region, and the bottom surface is curved upwards forming a central crest region, with the central trough region of the upper surface and the central crest region of the lower surface aligned so that the bilge keel has a substantially biconcave cross section.

9. The bilge keel of claim 8, wherein the free end forms a flat edge that extends from the bottom surface to the upper surface.

10. The bilge keel of claim 8, wherein the free end forms a forked edge that from the bottom surface extends inwards towards the attachment end, and at a substantially halfway point between the bottom and upper surfaces, extends back outwards in an opposite direction to the upper surface.

11. The bilge keel of claim 10, wherein the advanced bilge keel has a lateral sectional length L that includes a forked edge length R, wherein the forked edge length R is about 0.10 to about 0.15 of the lateral sectional length L.

12. The bilge keel of claim 8, the free end forms an arrow-pointed edge that from the bottom surface extends outwards away from the attachment end, and at a substantially halfway point between the bottom and upper surfaces, extends inwards in an opposite direction to the upper surface.

13. The bilge keel of claim 12, wherein the bilge keel has a lateral sectional length L that includes an arrow-pointed edge length r, wherein the arrow-pointed edge length r is about 0.10 to about 0.15 of the lateral sectional length L.

14. A bilge keel mountable to a ship hull within or below a waterline region, comprising:

an attachment end attachable to the hull;

a free end;

a curved upper surface extending from the attachment end to the free end; and a curved bottom surface below the curved upper surface, extending from the attachment end to the free end, wherein the upper surface is curved upwards forming a central crest region, and the bottom surface is curved upwards forming a central crest region, and wherein the central crest region of the upper surface and the central crest region of the lower surface offset so that at the distance between the upper and bottom surfaces at the attachment end is great than the distance between the upper and bottom surfaces at the free end, and wherein the free end forms a cambered edge with an acute angle being formed between the bottom surface and the cambered edge and an obtuse angle formed between the upper surface and the cambered edge.

* * * * *